US006590541B1

(12) United States Patent
Schultze

(10) Patent No.: US 6,590,541 B1
(45) Date of Patent: Jul. 8, 2003

(54) HALF-LOOP ANTENNA

(75) Inventor: Ralf Schultze, Berlin (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/857,930

(22) PCT Filed: Dec. 10, 1999

(86) PCT No.: PCT/DE99/03966

§ 371 (c)(1),
(2), (4) Date: Sep. 18, 2001

(87) PCT Pub. No.: WO00/36703

PCT Pub. Date: Jun. 22, 2000

(30) Foreign Application Priority Data

Dec. 11, 1998 (DE) ..... 198 57 191

(51) Int. Cl.[7] ..... H01Q 21/26; H01Q 21/24; H01Q 1/22

(52) U.S. Cl. ..... 343/741; 343/797; 343/745; 343/866

(58) Field of Search ..... 343/795, 741, 343/797, 700 MS, 742, 846, 853, 866, 828, 848, 745, 749

(56) References Cited

U.S. PATENT DOCUMENTS

| | | | | |
|---|---|---|---|---|
| 3,618,104 A | * | 11/1971 | Behr | 343/745 |
| 3,906,507 A | * | 9/1975 | Allen, Jr. | 333/238 |
| 4,433,336 A | * | 2/1984 | Carr | 343/728 |
| 5,294,938 A | | 3/1994 | Matsuo et al. | 343/829 |
| 5,521,610 A | | 5/1996 | Rodal | 343/797 |
| 5,592,182 A | * | 1/1997 | Yao et al. | 343/742 |
| 5,654,724 A | * | 8/1997 | Chu | 343/742 |
| 5,784,032 A | | 7/1998 | Johnston et al. | 343/702 |
| 6,111,549 A | * | 8/2000 | Feller | 343/700 MS |

FOREIGN PATENT DOCUMENTS

| | | |
|---|---|---|
| DE | 195 14 556 | 10/1996 |
| EP | 0 444 679 | 9/1991 |
| EP | 0 684 661 | 11/1995 |
| EP | 0 795 925 | 9/1997 |

* cited by examiner

*Primary Examiner*—Don Wong
*Assistant Examiner*—Chuc D Tran
(74) *Attorney, Agent, or Firm*—Kenyon & Kenyon

(57) ABSTRACT

The present invention relates to a half-loop antenna having an antenna half-loop positioned on top of a ground plane, the antenna half-loop forming an area whose outer edge forms a convex closed curve, that is, it is curved toward the outside. Preferably, the developed view of the conductor half-loop has the form of an ellipse tapering to a point at its ends, and at the feed-in point of the conductor half-loop an inductance can be inserted, formed as a spring.

24 Claims, 7 Drawing Sheets

HALF-LOOP ANTENNA

FIELD OF THE INVENTION

The present invention relates to a half-loop antenna, particularly a half-loop antenna for use in a motor vehicle.

BACKGROUND INFORMATION

The half-loop antenna known from the literature includes a semicircular-shaped metallic curved conductor or curved antenna piece positioned over a ground plate (ground plane), as illustrated, by way of example, in FIG. 5. The mode of operation of the known half-loop antenna corresponds to that of a folded monopole antenna. Furthermore, its field pattern in the vertical and horizontal plane approximates that of a monopole, for example, that of a $\lambda/4$ antenna. A half-loop antenna designed for a resonant length of $\lambda/2$ has an overall height of 83% of that of a $\lambda/4$ antenna. If one energizes one side of the curved conductor piece and contacts the other side to the base plate or earth plane, the antenna, at its resonant frequency has an impedance of 100Ω. Furthermore, increasing the capacity of an antenna effects a more broad-banded radiation behavior in the frequency band. Increasing the capacity of an antenna can also be reached effectively by enlarging the dimension of its voltage maximum. A $\lambda/2$ half-loop antenna has its voltage maximum at half the antenna height, that is, at the highest point of the conductor half-loop above the ground plane.

An antenna unit is described in European Published Patent Application No. 0 684 661 which has a substrate, and an antenna fastened to the substrate, whose radiating portion is a flat plate arranged parallel to the substrate. The radiating portion has a feed terminal and a ground terminal.

Also, in German Published Patent Application No. 195 14 556 a flat antenna arrangement is described for frequencies in the GHz band, which includes an antenna for satellite-supported vehicle navigation (GPS) and at least one antenna for mobile radio, which are positioned in a common housing on a conducting surface of greater dimension, in particular, on a vehicle body. In this connection, the GPS antenna is preferably formed as a strip line antenna with broadside radiation, includes a plate made of a dielectric material, which is continuously metallized as ground surface on one side, and provided with partial metallization in the radiation direction on the other side, and wherein the mobile radio antenna has omnidirectional characteristics in the horizontal field pattern and the large conducting surface is used as ground reference surface for this antenna.

The disadvantage with the known flat antennas is their necessary area requirement, especially when they are used with motor vehicles.

SUMMARY OF THE INVENTION

Therefore, an object of the present invention is based on developing a half-loop antenna which can specifically be applied in the motor vehicle field for mobile radio, and wherein a type of construction can be achieved that is as compact and small in area as possible, while maintaining good antenna characteristics.

In a half-loop antenna according to the present invention, having a metallic curved antenna piece which is arranged opposite a ground plane designed as ground and the curved antenna piece is connected at one end with the ground plane and has the antenna signal at the other end, the curved antenna piece is formed by an area whose outer edge forms a convex curve, that is, it is arched toward the outside.

Preferably, the area of the curved antenna piece is arranged to be either parallel to the ground plane or arched toward the outside. The area of the curved antenna piece can also be arranged to be at an angle to the ground plane.

In a preferred embodiment, the development of the curved antenna piece has the form of an ellipse tapering to a point at its ends.

In order further to decrease the overall height of the antenna, an inductance is inserted at the antenna signal side of the curved antenna piece. In addition, the connection between the curved antenna piece and the ground plane can be made by a further inductance.

Preferably, the planar curved antenna piece has a dielectric on its outer side. Then too, the antenna can be protected by a radom, the radom being applied as dielectric.

In another preferred development, the inductance, or inductances, as the case may be, is/are formed as a spring, whose restoring force presses the metallic area of the curved antenna piece, or parts of it, against the radom.

The metallic curved antenna piece can also be applied to the inside of the radom as a metallic surface.

The antenna surface of the half-loop antenna can also be developed as a skeleton antenna, the surface of the curved antenna piece being formed by a thin metallic conductor which forms the outer edge of the antenna surface.

Advantageously, an increase in the capacity of the antenna at the smallest ground plane is effected by the design of the curved antenna piece as a surface with a convex edge, and this achieves a more broad-banded radiation behavior in the frequency band. Furthermore, by increasing the self-capacitance of the antenna, the impedance at the resonance or operating frequency can be shifted to lower values such as 50Ω. Advantageously, too, neither the horizontal nor the vertical field pattern is influenced by the selected geometry, or rather, is influenced to only a slight degree. Raising the capacity offers the possibility of shortening the mechanical length of the curved antenna piece, so that, with a corresponding shortening of the mechanical length of the curved antenna piece the overall height is reduced to 50% of a $\lambda/4$ antenna.

It is especially advantageous that a feed network is positioned between the curved antenna piece and one of the antenna terminals, the feed network having at least one first resonant circuit which includes an inductance and a capacitance. In this way, the half-loop antenna can transmit or receive signals in at least two frequency ranges. Thus, a multiband-capable half-loop antenna is realized, which simultaneously, to the greatest extent possible, has a compact and small surface type of construction.

A further advantage is that the feed network includes at least one additional impedance, selected in such a way that the impedance of the half-loop antenna is adapted to a preset impedance at the antenna input. In this way, fine tuning of the impedance of the half-loop antenna in the respectively used frequency bands can be accomplished.

A further advantage is that the feed network has a plurality of resonant circuits of various resonant frequencies. In that way, more than two frequency ranges can be realized, in which the half-loop antenna can send and/or receive signals while simultaneously keeping its compact and small surface type of construction.

DETAILED DESCRIPTION

Figure 1:
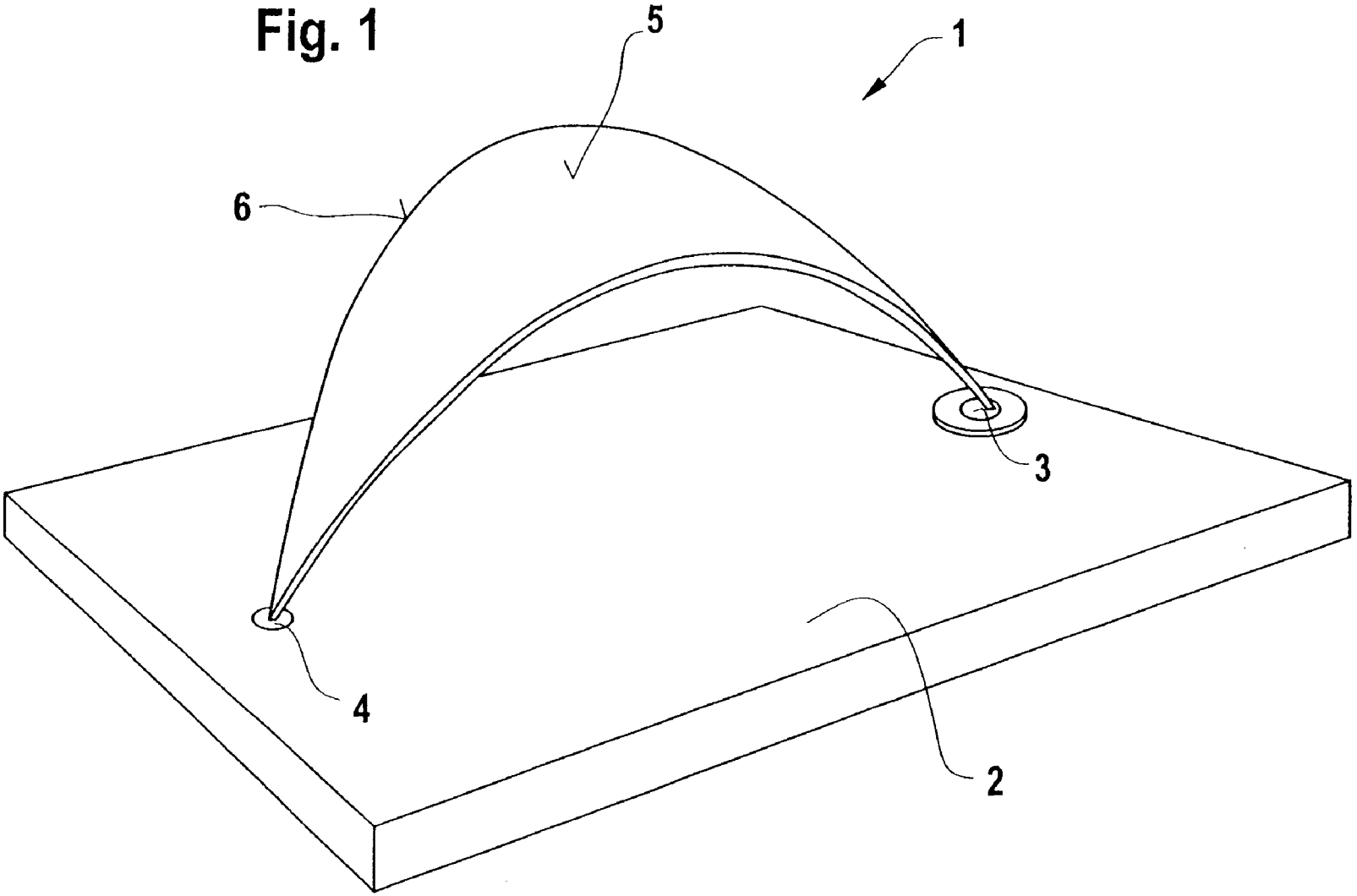
FIG. 1 shows a first specific embodiment of the half-loop antenna according to the present invention.

FIG. 1 shows the first specific embodiment of the half-loop antenna according to the present invention, including a flat metallic curved antenna piece 1, which is positioned above a ground plane 2, the curved antenna piece 1 having its feed-in at point 3, that is, the antenna signal, while the other end contacts the ground plane 2 at point 4. Thus, the half-loop antenna acts as a folded monopole antenna. In the preferred embodiment, the surface 5 of the curved antenna piece 1 in a developed view has the form of an ellipse tapering to a point at its ends. In general, the edge 6 bounding the antenna surface 5 is a concave, closed curve, that is, it is arched toward the outside. An increase in the capacity of the antenna is brought about by this flat embodiment, so that a more broadbanded radiation behavior is achieved. Furthermore, by the increase of the self-capacitance, the impedance of the antenna, at resonance or operating frequency, can me be shifted to lower values, such as 50Ω, the horizontal as well as the vertical field pattern, however, not being influenced, or being influenced only to a minor degree, by the flat, or, in the present case, curved geometry.

Increasing the capacity also offers the possibility of shortening the mechanical length of the curved conductor piece. For example, the overall height is reduced to ca. 50% of that of a λ/4 antenna, for a corresponding reduction in the mechanical length of the curved conductor piece.

Furthermore, the antenna furnished with the flat geometry, compared to the half-loop antennas known from the literature, has an impedance adapted to the source of the transmission or to the receiver, a greater bandwidth, as well as a lower overall height, at an unchanged field pattern. The broadening of the antenna geometry corresponds in its effect to the top capacity of a λ/4 antenna.

Figure 2:
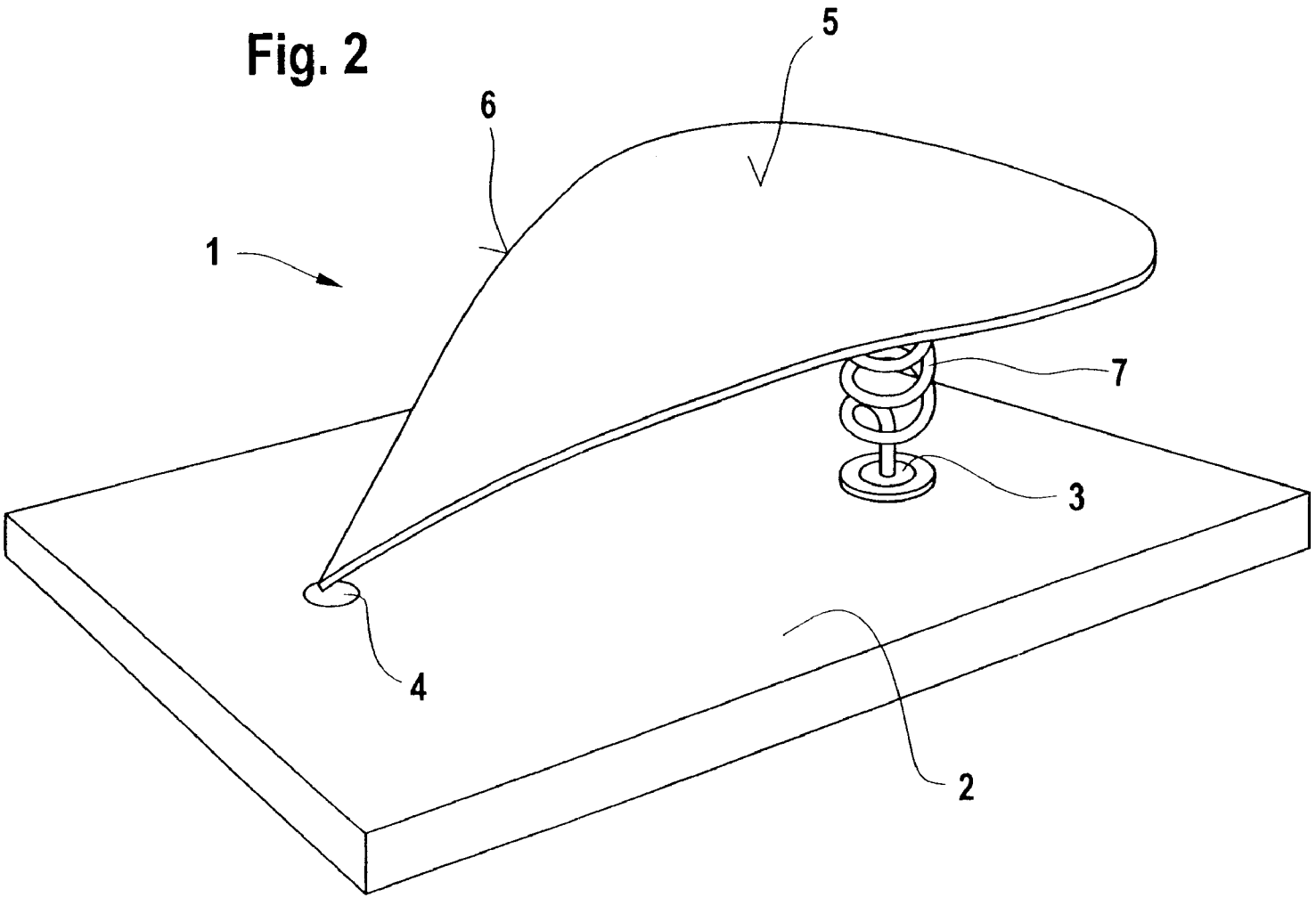
FIG. 2 shows a second specific embodiment of the half-loop antenna according to the present invention.

FIG. 2 shows a further specific embodiment of the half-loop antenna. In order to shorten the mechanical length of the curved antenna piece 1, an inductance 7, that is, a loading coil, can be positioned into the curved antenna piece 1. In the illustrated second specific embodiment, the loading coil 7 is inserted at feed-in point 3 This yields a developed view of the curved antenna piece 1in the form of an ellipse which is tapered to a point at only one end. Furthermore, surface 5 of the curved antenna piece 1runs essentially at an angle (as seen from the ground point 4) up to parallel to the ground plane 2 (as seen in the Figure at the rear edge of surface 6). Since the λ/2 half-loop antenna has its maximum currents at the ends of the curved conductor piece, that is, at feed-in point 3 and at contact point 4 to the ground plate 2, it develops its greatest effect there. Through the insertion of the loading coil 7 at the feed-in point 3 of the curved antenna piece 1, because of the shortening, only the remaining segment, i.e. the surface 5 of the conductor half-loop 1 remains as radiation emitter. This makes possible a further decrease in the overall height to 30% of a λ/4 antenna, as well as a shortening of the overall length. That corresponds to an overall height of 0.08 λ. Because the bandwidth of the antenna was increased considerably before, on account of the top capacity, one can live with the bandwidth decrease caused by the loading coil. In addition, the beam power in the useful frequency band of this antenna, according to the second specific embodiment, shows no clear loss compared to a λ/4 antenna.

Figure 3:
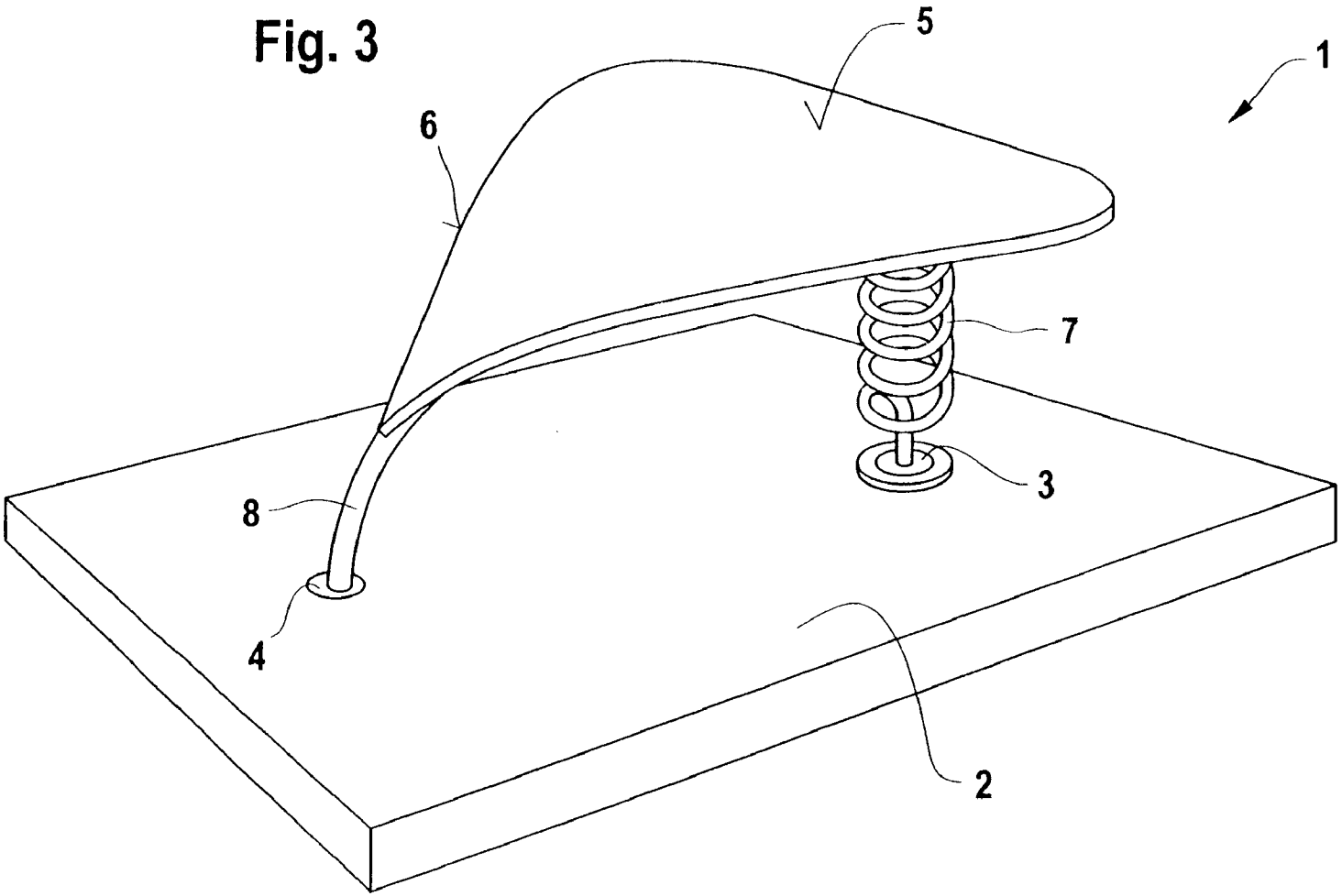
FIG. 3 shows a third specific embodiment of the half-loop antenna according to the present invention.

FIG. 3 shows a third specific embodiment of the half-loop antenna according to the present invention, in which a further loading coil 8 (inductance) is inserted into the curved antenna piece 1. The further loading coil 8 is inserted at location 4 of the curved antenna piece, contacting the ground plane 2, and it distributes the total inductance to the two loading coils at the curved conductor piece ends, whereby one obtains an antenna formed in such a way that it has a metallic surface 5 of greater extension over the ground plane (ground plate) having a certain clearance from it.

When using an antenna in a mobile application, it makes sense to protect it using a radom for protection against the influence of weather.

Furthermore, an increase of the antenna's capacity can be attained most effectively by enlarging the dimension of its maximum voltage or by assigning a dielectric at this point. Thus, the antennas according to the three specific embodiments can have a dielectric assigned to their upper side in order to raise the antenna capacity.

Consequently, with regard to the antennas corresponding to the above specific embodiments, the effect of a radom as a dielectric can be optimally used. In order also to keep the overall height of the antenna as low as possible, one is at pains to keep the clearance between antenna and radom to a minimum. If the metallic surface of the curved antenna piece now lies directly against the radom, the half-loop surface and therefore the overall length and width can be further reduced by the effect of the radom as a dielectric. In addition to this, an undefined detuning of the antenna is prevented, which can arise from different clearances of the radom from the metallic surface of the curved conductor piece because of production tolerances.

For all three above specific embodiments, therefore, a design is favorable, from a standpoint of production engineering, in which the metallic surface of the curved antenna piece, or parts thereof, are fastened directly to the inner side of the radom, or are vapor-deposited in the preferred case, and then contacted to the rest of the curved antenna piece 1.

It is also possible to design the loading coils 7, 8 corresponding to the second or third specific embodiment in such a way that they function as a spring, whose restoring force presses the metallic surface of the antenna half-loop 1, or parts thereof, against the radom.

Figure 4:
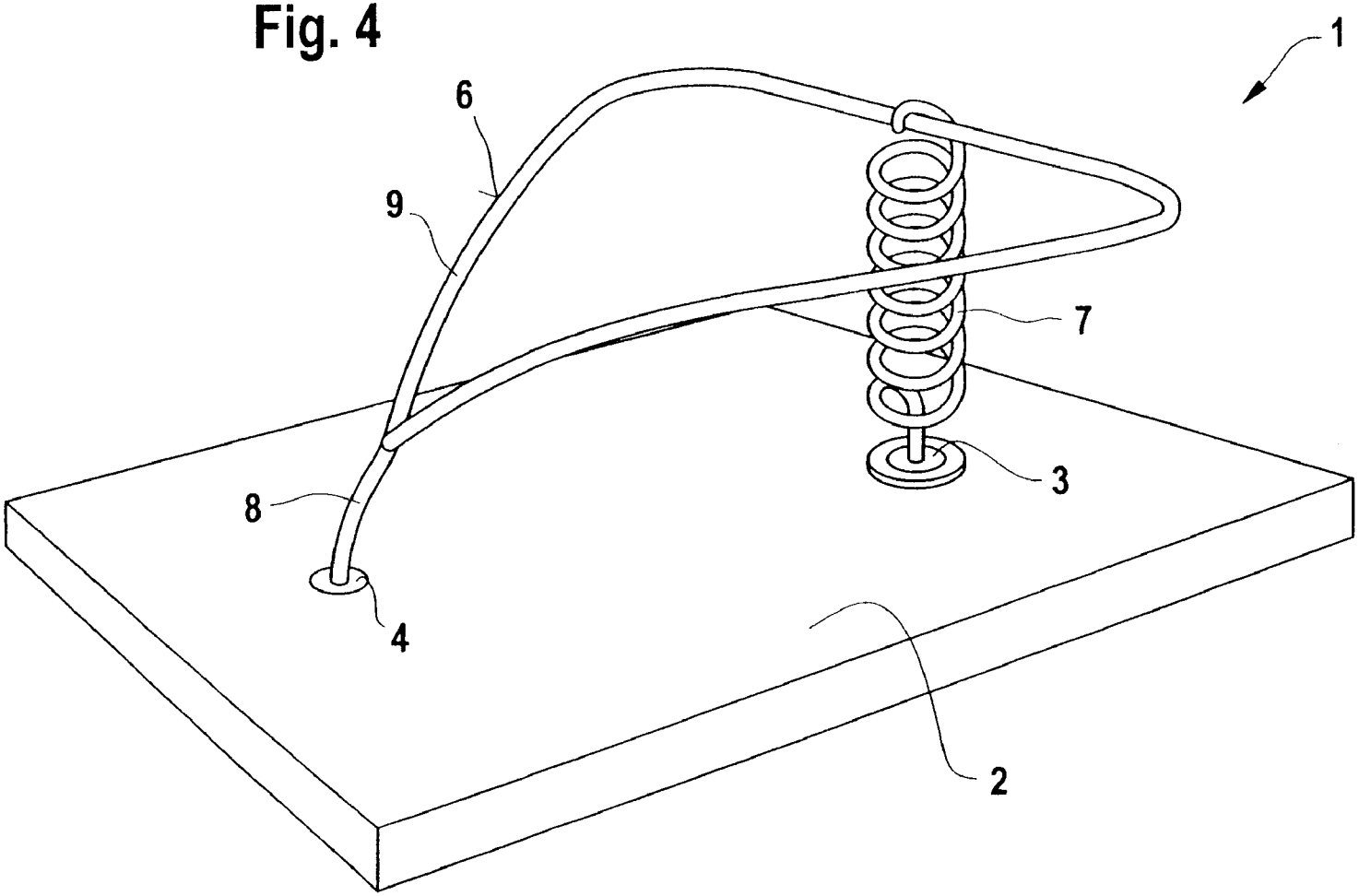
FIG. 4 shows a fourth specific embodiment of the half-loop antenna according to the present invention.
Figure 5:
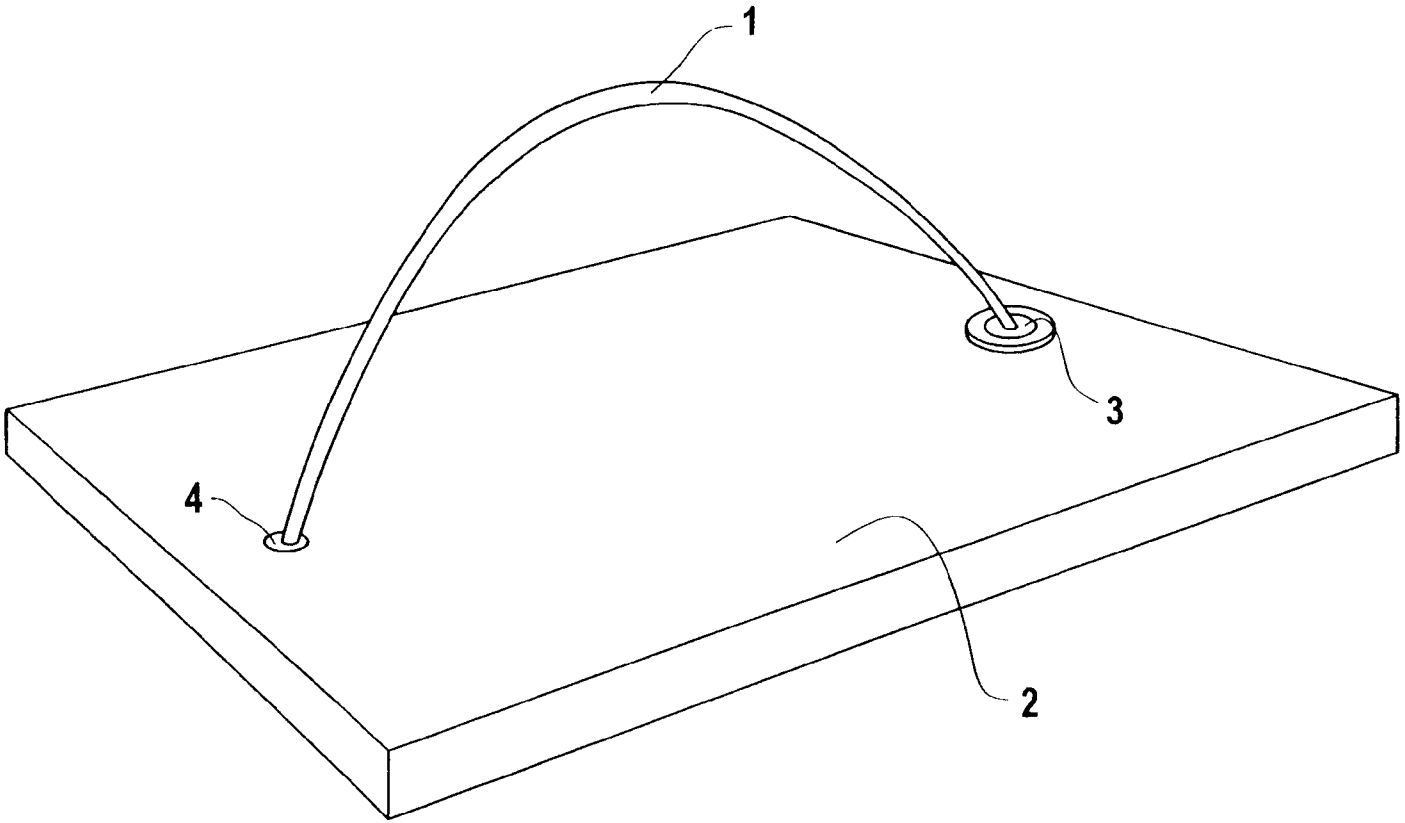
FIG. 5 shows a known half-loop antenna.

FIG. 4 shows a further specific embodiment of the half-loop antenna according to the present invention in which the top capacity is designed in the form of a skeleton antenna. In other words, the metallic surface 5 of the curved antenna piece 1is replaced by a thin metallic conductor 9, which represents the outer edge 6 of surface 5. Here is illustrated pictorially a skeleton antenna corresponding to the second specific embodiment. In such an antenna the possibility exist, advantageously, of positioning additional antennas below the half-loop antenna, such as a GPS patch antenna.

In order to live up to the growing requirements of wireless communication, multiband antennas are increasingly coming into use.

In a two-band operation, so-called two-band antennas are used, which can send and/or receive electromagnetic waves at two operating frequencies. Such a two-band antenna has one resonance for each operating frequency.

In the trend for such multiband applications there are above all flat antennas, which are easy to integrate or are suitable for hidden installation, such as in a motor vehicle. With such flat antennas, in order to achieve radiation and/or reception of a signal at a plurality of operating frequencies, either a plurality of resonator elements is required which differ in their resonance frequency and are either connected to a common feed-in point, or are coupled to a main resonator as parasitic resonators, or radiator elements are installed which are resonant at a plurality of frequencies.

For the use of a plurality of resonator elements, as well as for the use of radiator elements which are resonant at a plurality of frequencies, space is required which is frequently not at one's disposal in sufficient measure.

This poses the object of realizing such a flat antenna which, when using only one resonator element which is not resonant at a plurality of frequencies, can nevertheless carry out a transmitting and/or receiving operation at a plurality of operating frequencies.

The object is attained by inserting a feed network 10 between the antenna half-loop 1 and one of the antenna terminals 3, 4, the feed network 10 having at least one first resonant circuit 40; 50 which includes an inductance 15; 16 and a capacitance 20; 21. The antenna terminals 3, 4 are here, on the one hand, the feed-in point 3 and on the other hand the contact point to the ground plane 2, which forms a reference potential.

Figure 6:
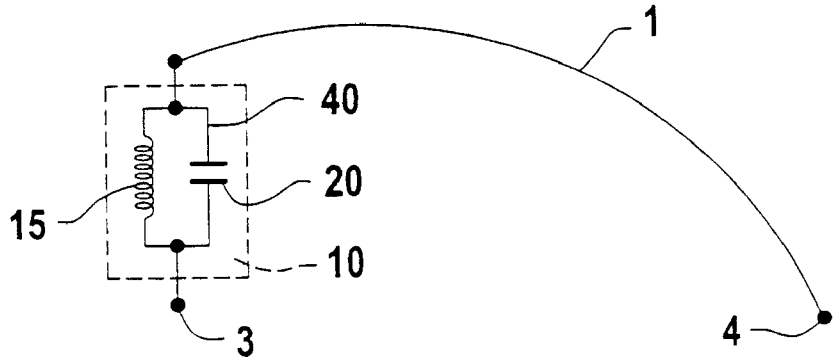
FIG. 6 shows a half-loop antenna having a feed network inserted in a first specific embodiment.

According to FIG. 6, the feed network 10 is arranged between the antenna half-loop 1 and the feed-in point 3. However, it could just as well be inserted between the antenna half-loop 1 and contact point 4 to the ground plane 2. In this connection, the feed network 10 has a first parallel resonant circuit 40 as first resonant circuit. The parallel resonant circuit 40 here represents a parallel circuit made up of a first inductance 15 and a first capacitance 20.

As described, one can reduce the mechanical length of the antenna half-loop 1 at constant resonance frequency by inserting an inductance into the antenna half-loop 1. Conversely, it is possible to increase the mechanical length of the antenna half-loop 1 at constant resonance frequency by inserting a capacitance into the antenna half-loop 1. As described before, impedances inserted into the antenna half-loop 1 develop their greatest effect at the maximum current of the half-loop antenna. This is the case with the described $\lambda/2$ half-loop antenna at the feed-in point 3 and at the contact point 4 to ground plane 2. Thus, the feed network 10 also has its maximum effect at the feed-in point 3 or the contact point 4.

In the feed network 10, according to FIG. 6, the first inductance 15 causes a first resonant frequency $f_{r1}$ below the resonant frequency that would be attained if only the antenna half-loop 1 were used as the half-loop antenna, that is, without feed network 10. The first capacitance 20 causes a second resonant frequency $f_{r2}$, which is greater than the first resonant frequency $f_{r1}$, and is higher than the resonant frequency that would be attained if only the antenna half-loop 1 were used as the half-loop antenna, that is, without feed network 10. Thus one obtains a two-band antenna including a first frequency range having a first resonant frequency $f_{r1}$ as center frequency and a second frequency range having a second resonant frequency $f_{r2}$ as center frequency for sending or receiving of signals, wherein the resonant frequency of the half-loop antenna would lie between the two frequency ranges in case of sole use of the antenna half-loop 1, that is, without feed network 10. The first inductance 15 and the first capacitance 20 here are dimensioned in such a way that the resonant frequency of the first parallel resonance circuit 40 lies between the two realized frequency bands or between the two resonant frequencies $f_{r1}$ and $f_{r2}$.

Compared to the single-band half-loop antenna designed for the first resonant frequency $f_{r1}$, a reduction in the structural size of the antenna half-loop 1 takes place.

It is also useful to dimension the impedance of the feed network 10 in such a way that, jointly with the impedance of the antenna half-loop 1, it results in a predefined impedance at the feed-in point 3, in both frequency ranges used for sending and/or receiving signals. When the feed network 10 is connected to contact point 4 to the ground plane 2, by suitably dimensioning the impedance of the feed network, a predefined impedance for this contact point 4 can then be correspondingly set. The desired impedance at feed-in point 3 or at contact point 4 to the ground plane 2 can come about by the appropriate dimensioning of the first inductance 15 and the first capacitance 20, as long as one keeps to the requirement that the resonant frequency of the first parallel resonant circuit 40 has to lie between the first resonant frequency $f_{r1}$ and the second resonant frequency $f_{r2}$. If the first inductance 15 and the first capacitance 20 cannot be dimensioned in such a way that the desired impedance at feed-in point 3 or at contact point 4 to the ground plane 2 can be attained, according to the present invention it can also be provided that at least one first additional impedance is positioned in feed network 10, selected so that the half-loop antenna is adjusted to the predefined impedance at the antenna terminals 3, 4, connected to feed network 10. Here, the at least one first additional impedance can be positioned in one leg of the first parallel resonant circuit 40, or in series or parallel with the first parallel resonant circuit 40. Starting from the exemplary embodiment as in FIG. 6, according to FIG. 7 the first parallel resonant circuit 40 is, for instance, expanded to the end that a matching inductance 25 is connected in series with the first capacitance 20 and is dimensioned so that the predefined impedance is set at feed-in point 3. In a further example as in FIG. 8, such a matching inductance 25 can also be connected in series with the first parallel resonant circuit 40, in order to attain the desired adjustment to the impedance at the feed-in point 3 according to FIG. 6. According to FIG. 9, a correspondingly dimensioned matching capacitance 26 can also be used, which, according to the example in FIG. 9, is connected in series with parallel resonant circuit 40, but could also be connected in series with first inductance 15 in parallel resonant circuit 40.

It can also be proposed that more than one additional impedance be provided in the feed network 10, and be connected in the manner described to the parallel resonant circuit 40. In that manner, fine tuning of the impedance of the half-loop antenna is attained at the particular antenna terminal 3, 4 to which the feed network 10 is connected. For connection to feed-in point 3, for example, a predefined impedance of 50Ω can be provided.

The feed network 10, which includes the first parallel resonant circuit 40 having the first inductance 15 and the first capacitance 20, according to the example in FIG. 6, represents a simple and cost-effective solution to the realization of a half-loop antenna which can transmit or receive signals in two different frequency ranges.

Figure 11:
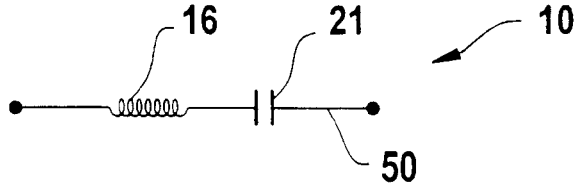
FIG. 11 shows a feed network in a sixth specific embodiment.

In corresponding fashion, the feed network 10 can also be designed as a series resonant circuit, as shown in FIG. 11 with the aid of a first series resonant circuit 50. The first series resonant circuit 50 here includes a second inductance 16 connected in series to a second capacitance 21. Tuning or fine tuning of the impedance of the first series resonant circuit 50, for attaining the predefined impedance of the half-loop antenna at feed-in point 3 or at contact point 4 to the ground plane 2, can now be attained, starting from the first series resonant circuit 50, by inserting one or a plurality of appropriately dimensioned, additional impedances into feed network 10. This can be done, for example, by connecting a further capacitance in parallel to the second inductance 16 or to the entire series resonant circuit 50. Correspondingly this can also be done by connecting a further inductance in parallel to the second capacitance 21 or to the entire first series resonant circuit 50.

Figure 12:
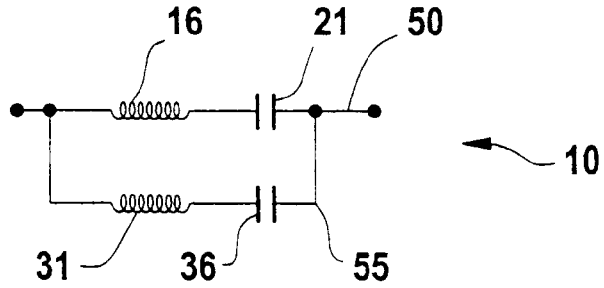
FIG. 12 shows a feed network in a seventh specific embodiment.
Figure 13:
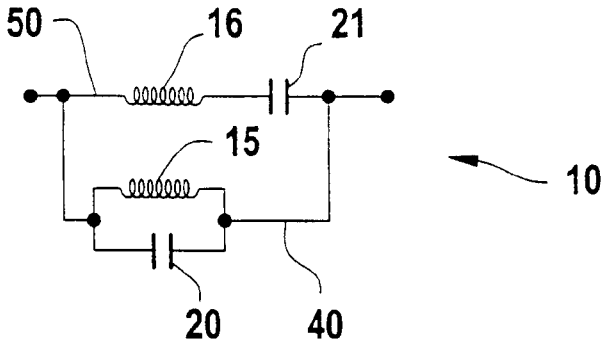
FIG. 13 shows a feed network in an eighth specific embodiment.

In order to implement more than two frequency bands for transmitting and/or receiving signals using the half-loop antenna, it can be provided that the feed network 10 have a plurality of resonant circuits of different resonant frequencies. For this, the feed network 10 can contain, for example, a parallel circuit made up of two series resonant circuits 50, 55, as illustrated in FIG. 12. According to FIG. 12, a second series resonant circuit 55 is connected in parallel to the first series resonant circuit 50, the second series resonant circuit 55 here being formed of a fourth inductance 31 and a fourth capacitance 36 connected to it in series. In a further example, as in FIG. 10, it can be provided that the feed network 10 contain two parallel resonant circuits 40, 45 connected in series. Here, according to FIG. 10, a second parallel resonant circuit 45 is connected in series to the first parallel resonant circuit 40, the former being a parallel connection of a third inductance 30 and a third capacitance 35. FIG. 13 illustrates as a further example a parallel connection of the first parallel resonant circuit 40 to the first series resonant circuit 50, this parallel connection forming the feed network 10.

In a corresponding manner it can also be provided that a triband half-loop antenna be attained by connecting in series a parallel resonant circuit with a series resonant circuit.

Figure 10:
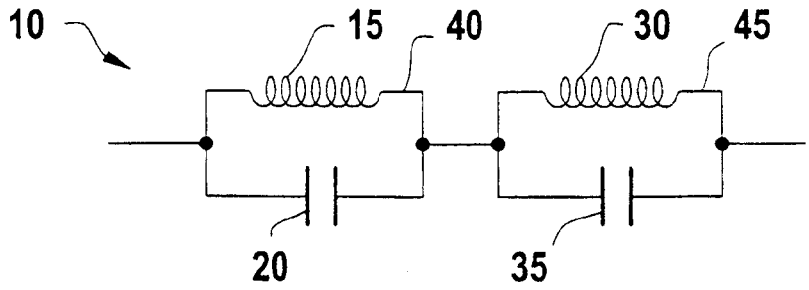
FIG. 10 shows a feed network in a fifth specific embodiment.

In using two resonant circuits as in FIG. 10 or FIG. 12, three frequency ranges can be realized, in which the half-loop antenna can transmit and/or receive signals. In this connection, the inductances and capacitances of the two respective resonant circuits are to be dimensioned in such a way, that the resonant frequencies of the individual resonant circuits lie between the frequency ranges of the half-loop antenna which are usable for transmitting and/or receiving.

Figure 14:
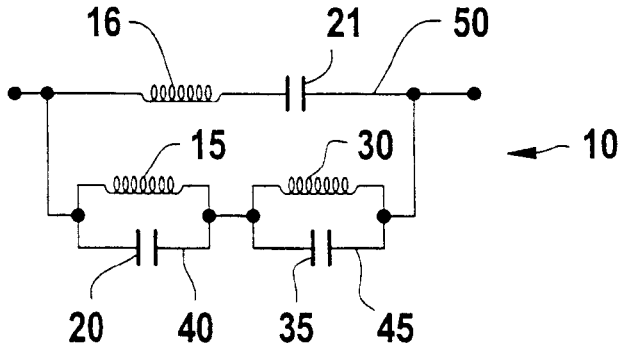
FIG. 14 shows a feed network in a ninth specific embodiment.

Even more frequency bands for transmitting and/or receiving, using the half-loop antenna, are attained by using further resonant circuits. Thus, for example, more than two parallel resonant circuits could be connected in series, or more than two series resonant circuits could be connected in parallel. Several series and parallel resonant circuits can also be connected to one another in series or in parallel, wherein attention should be paid that two series resonant circuits should not be connected in series, and two parallel resonant circuits should not be connected in parallel. The resonant circuits are here respectively to be dimensioned in such a way that their resonant frequencies lie between the individual frequency ranges of the half-loop antenna used for transmitting and/or receiving of signals, and that they can be differentiated from one another. In general, in a feed network 10 having n resonant circuits, n+1 frequency ranges can be realized for the half-loop antenna for the purpose of transmitting and/or receiving. FIG. 14 shows as an example a parallel connection of the first series resonant circuit 50 having a series connection of the first parallel resonant circuit 40 and the second parallel resonant circuit 45. Here, the first series resonant circuit 50 could, for example, be connected in parallel to a series connection of more than two parallel resonant circuits, or also to a series connection of a plurality of parallel resonant circuits and a series resonant circuit.

Figure 7:
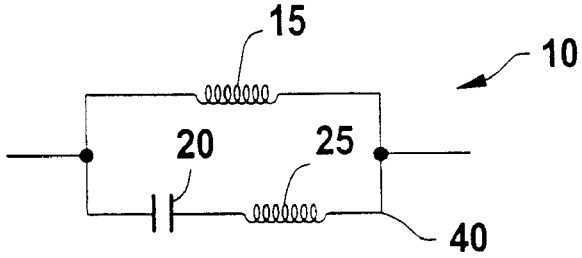
FIG. 7 shows a feed network in a second specific embodiment.
Figure 8:
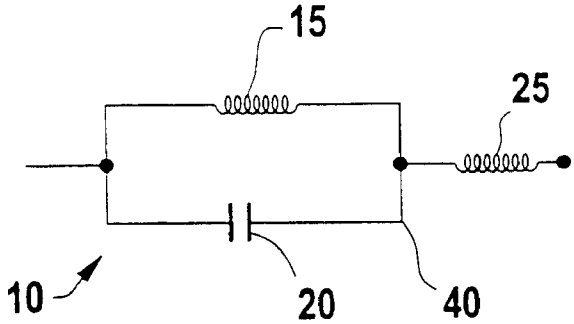
FIG. 8 shows a feed network in a third specific embodiment.
Figure 9:
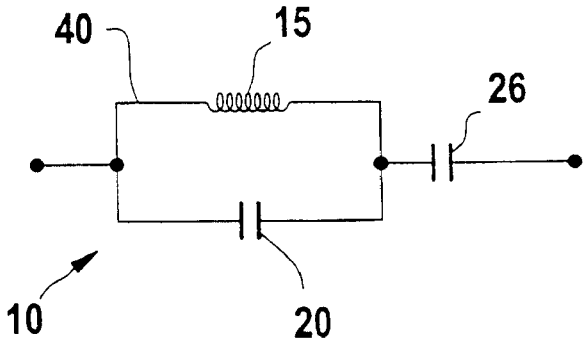
FIG. 9 shows a feed network in a fourth specific embodiment.

Fine tuning of impedance matching in such half-loop antennas having more than two frequency ranges for transmitting and/or receiving of signals takes place here in the described manner by the appropriate insertion of additional impedances as was described in FIG. 7, FIG. 8 and FIG. 9. One or a plurality of additional impedances can be used for this. As described, these can be positioned in one or a plurality of legs of each resonant circuit of the feed network 10, or in series or in parallel thereto.

With such a two-band half-loop antenna or a multiband half-loop antenna a strong mutual influence takes place, on the one hand between feed network 10 and the antenna half-loop 1, and on the other hand between the impedances of the feed network 10. In addition, the feed network 10 generates a current assignment on the antenna half-loop 1 which makes possible good radiation in all operating frequency ranges of the half-loop antenna. By the appropriate dimensioning of the described flat design of the antenna half-loop 1 and the capacitance of the antenna half-loop 1 connected with it, the antenna half-loop 1, in connection with the feed network 10, can be tuned in such a way that the beam power from the half-loop antenna in the operating frequency ranges exhibits the most minor losses compared to that of $\lambda/4$ antennas. The field pattern of the half-loop antenna in the vertical and the horizontal plane is here approximately that of a monopole, and, like that, for instance, of a $\lambda/4$ antenna.

The antennas according to the preferred specific embodiments have a tapering profile in the side view as well as the top view, which has aerodynamically favorable properties. When using two loading coils whose inductance is distributed unsymmetrically, one can determine the angle of climb of the lateral profile, or rather change the shape of the profile itself. In this connection, both a profile rising in a straight line and one rising in a curve can be realized. If the radom is also adapted to this double wedge shape, because of its good aerodynamic properties, the antenna in its entirety is superbly suitable for mobile application on vehicles, preferably in a mounting position on the vehicle roof or the trunk lid. Besides its good aerodynamic properties, the antenna is also suitable as on-glass antenna, since, when it is mounted at the upper edge of the front or rear window, it forms a flowing transition to the automobile body because of its wedge-shaped form design.

The application area of the above-described flat antennas covers, among other things, transmitting and receiving signals in the GSM band. If a dielectric rod antenna for radio reception, into which a further antenna for transmitting and receiving of signals in the GSM band could be integrated, is not present or is not available, for instance, because it was designed in the form of a rear window antenna, the possibility exists of installing such a GSM antenna separately. Preferably, such flat antennas are installed where they can be integrated into the vehicle geometry. Additionally, radiation of the passengers in case of an antenna having omnidirectional characteristics can be minimized when it is mounted on, or directly at the vehicle roof.

By appropriate dimensioning of the antenna, it can also be used for transmitting and receiving vertically polarized electromagnetic waves in other frequency bands, for example in the E-Net.

What is claimed is:

1. A half-loop antenna, comprising:

a ground plane arranged as ground;

a metallic area including an outer edge forming a convex curve and being arched toward an outside; and a metallic antenna half-loop arranged opposite the ground plane, the metallic antenna half-loop being connected at one end with the ground plane and having a connection to an antenna signal at another end, wherein the metallic antenna half-loop has the metallic area, the metallic area is positioned at an angle, and at least a portion of the metallic area is positioned parallel to the ground plane.

2. The half-loop antenna according to claim 1, wherein:

the metallic area is positioned arched outward with respect to the ground plane.

3. The half-loop antenna according to claim 1, wherein:

a developed view of the metallic antenna half-loop has a shape of an ellipse tapering to a point at ends thereof.

4. The half-loop antenna according to claim 1, further comprising:

a radom.

5. The half-loop antenna according to claim 4, wherein:

the radom acts includes a dielectric.

6. The half-loop antenna according to claim 4, wherein:

the metallic area is deposited on an inside of the radom.

7. The half-loop antenna according to claim 1, wherein:

the metallic area includes a dielectric on an outside thereof.

8. The half-loop antenna according to claim 1, further comprising:

a thin metallic conductor forming an outer edge of the metallic area, wherein:

the metallic antenna half-loop is realized as a skeleton antenna.

9. A half-loop antenna, comprising:

a ground plane arranged as ground;

a metallic area including an outer edge forming a convex curve and being arched toward an outside;

a metallic antenna half-loop arranged opposite the ground plane, the metallic antenna half-loop being connected at one end with the ground plane and having a connection to an antenna signal at another end, wherein the metallic antenna half-loop has the metallic area, the metallic area is positioned at an angle, and at least a portion of the metallic area is positioned parallel to the ground plane; and an inductance inserted at the other end of the metallic antenna half-loop.

10. The half-loop antenna according to claim 9, further comprising:

another inductance at which is made a connection between the metallic antenna half-loop and the ground plane.

11. A half-loop antenna, comprising:

a ground plane arranged as ground;

a metallic area including an outer edge forming a convex curve and being arched toward an outside;

a metallic antenna half-loop arranged opposite the ground plane, the metallic antenna half-loop being connected at one end with the ground plane and having a connection to an antenna signal at another end, wherein the metallic antenna half-loop has the metallic area, the metallic area is positioned at an angle, and at least a portion of the metallic area is positioned parallel to the ground plane;

a radom; and an inductance inserted at the other end of the metallic antenna half-loop, wherein:

the inductance includes a spring having a restoring force that presses at least a part of the metallic area, enclosed by the metallic antenna half-loop, against the radom.

12. A half-loop antenna, comprising:

a ground plane arranged as ground;

a metallic area including an outer edge forming a convex curve and being arched toward an outside;

a metallic antenna half-loop arranged opposite the ground plane, the metallic antenna half-loop being connected at one end with the ground plane and having a connection to an antenna signal at another end, wherein the metallic antenna half-loop has the metallic area, the metallic area is positioned at an angle, and at least a portion of the metallic area is positioned parallel to the ground plane;

a radom;

an inductance inserted at the other end of the metallic antenna half-loop; and another inductance at which is made a connection between the metallic antenna half-loop and the ground plane, wherein:

each one of the inductance and the other inductance includes a respective spring respectively having a restoring force that presses at least part of the metallic area, enclosed by the metallic antenna half-loop against the radom.

13. A half-loop antenna, comprising:

a ground plane arranged as ground;

a metallic area including an outer edge forming a convex curve and being arched toward an outside;

a metallic antenna half-loop arranged opposite the ground plane, the metallic antenna half-loop being connected at one end with the ground plane and having a connection to an antenna signal at another end, wherein the metallic antenna half-loop has the metallic area, the metallic area is positioned at an angle, and at least a portion of the metallic area is positioned parallel to the ground plane;

antenna terminals; and a feed network inserted between the metallic antenna half-loop and one of the antenna terminals and including at least one first resonant circuit that includes an inductance and a capacitance.

14. The half-loop antenna according to claim 13, wherein:

the at least one first resonant circuit is formed as a parallel resonant circuit.

15. The half-loop antenna according to claim 13, wherein:

the at least one first resonant circuit is formed as a series resonant circuit.

16. The half-loop antenna according to claim 13, wherein:

the feed network is connected to a feed-in point.

17. The half-loop antenna according to claim 13, wherein:

the feed network is connected to the ground plane.

18. The half-loop antenna according to claim 13, wherein:

the feed network includes at least one first additional impedance that is selected so that the feed network is adjusted to a predefined impedance at the antenna terminals connected to the feed network.

19. The half-loop antenna according to claim 18, wherein:

the at least one first additional impedance is positioned according to one of:

in a leg of the at least one first resonant circuit, in series to the at least one first resonant circuit, and parallel to the at least one first resonant circuit.

20. The half-loop antenna according to claim 13, wherein:

the feed network includes a plurality of resonant circuits of diversified resonant frequencies.

21. The half-loop antenna according to claim 20, wherein:

two of the plurality of resonant circuits are parallel resonant circuits that are connected in series.

22. The half-loop antenna according to claim 20, wherein:

two of the plurality of resonant circuits are series resonant circuits that are connected in parallel.

23. The half-loop according to claim 20, wherein:

the plurality of resonant circuits includes a series resonant circuit and a parallel resonant circuit connected one of parallel and in series with respect to each other.

24. The half-loop antenna according to claim 20, further comprising:

a series resonant circuit, wherein:

the plurality of resonant circuits includes a series circuit formed of a plurality of parallel resonant circuits, and the series resonant circuit is connected in parallel to the series circuit.

* * * * *